United States Patent [19]

Varon et al.

[11] 4,316,546

[45] Feb. 23, 1982

[54] HANG RAIL SUPPORT AND HANG RAIL

[75] Inventors: David S. Varon, Highland Park; Irving Silverman, Lincolnwood, both of Ill.

[73] Assignee: Crown Metal Mfg. Co., Chicago, Ill.

[21] Appl. No.: 123,110

[22] Filed: Feb. 20, 1980

[51] Int. Cl.[3] ..... A47H 1/02

[52] U.S. Cl. ..... 211/105.1; 248/251

[58] Field of Search ..... 211/105.1, 123; 248/251; 403/346, 372; 16/2

[56] References Cited

U.S. PATENT DOCUMENTS

| | | | |
|---|---|---|---|
| 1,022,387 | 4/1912 | Czimeg | 403/346 |
| 2,300,746 | 11/1942 | Phillips | 403/346 X |
| 4,150,753 | 4/1979 | Stahl et al. | 248/251 X |

*Primary Examiner*—Ernest R. Purser

*Attorney, Agent, or Firm*—Silverman, Cass & Singer, Ltd.

[57] ABSTRACT

A hang rail support and bracket in which the hang rail is of rectangular cross section and is adapted to be supported in such a manner that other brackets may be secured along the length of the rail and have merchandize hung therefrom in cantilever fashion. The support and bracket is adapted to be secured to a vertical standard such as the conventional slotted ones and has a vertically extending notch fitting the hang rail with a laterally extending tab that has been shear formed and bent from the material removed from the notch, the tab also having a bumper of yieldable material that presses against a lateral side of the rail to hold the rail firmly in the notch. The notch prevents the rail from rotating; the bumper prevents the rail from being accidentally removed from the notch by frictionally resisting relative movement of the rail.

Various forms of the support and rail arrangement are disclosed.

23 Claims, 11 Drawing Figures

HANG RAIL SUPPORT AND HANG RAIL

BACKGROUND OF THE INVENTION

The invention herein is primarily concerned with the class of articles that are known as store fixtures but particularly is concerned with an assembly that is used for merchandizing clothing. No limitation is intended by this statement.

In U.S. Pat. No. 3,685,662 there is disclosed a merchandizing system primarily for clothing in which a pair of spaced brackets is mounted to the conventional slotted standards that can be secured to a wall; each has an adapter of special construction secured to its front end; and there is a hang rail of special construction extending between the adapters and supported by the brackets. It is intended that clothing items on hangers offered for sale or on display will be engaged onto the hang rail and be supported thereby to enable these items to be hung in orderly fashion while being capable of sliding movement along the rail to enable their viewing.

This type of structure is especially useful when the rail itself is to support the clothing items directly, but has less utility when it is desired to have a plurality of items arranged along a support, for example a short length of tubing, which extends forwardly from the rail such as in a plane normal thereto. Thus, in the process of examining articles of clothing that are mounted on a hang rail, the customer may wish to see a series of articles from different areas but wants to examine them closely in one place. The articles are gathered together and there may be short cantilever mounted rods secured to the wall and upon which the salesperson will hang the gathered articles.

It would be convenient to have the short cantilever mounted rods hung from the main hang rail and for this purpose it has been proposed to utilize rectangular cross section hang rods or horizontally disposed bars to mount the cantilever rods. In such cases, the cantilever rod has an inverted U-shaped member at its secured end which engages closely over the rectangular hang rail or bar. One such structure is disclosed in U.S. Pat. No. 4,150,753 wherein there is shown a merchandise display fixture based upon a pair of spaced brackets which are secured to a wall by means of slotted vertical standards or the like. Each bracket has a right angle bent portion at its distal end and a rearwardly extending reversely turned wing integral with the right angle bent portion. Aligned vertical slots in the main part of the bracket and the reversely turned wing receive the bar which is installed in a downward movement and the right angle bent portion has a cam button which engages the front face of the bar when it is installed so that the bar is frictionally engaged in the slots. The pressure of the cam button is intended to prevent inadvertent removal of the bar, lengthwise sliding during use and the notches are expected to keep the bar from rotating during use.

The invention herein is directed to a structure which obviates some of the disadvantages of the structure of said U.S. Pat. No. 4,150,753. The structures which are illustrated and described in said last-mentioned patent are complex in that they require complicated tools and dies for manufacture; they are wasteful of material because they require a bracket made from a metal member whose length is at least equal to the length of the bracket from rear to front plus the length of the right angle bent portion on the front end plus the length of the reverse turned wing; they are further wasteful of material in that the metal cut from the bracket to form the slots is all discarded.

The invention herein is directed to a structure which is simple, economical to manufacture and is highly effective to achieve the ends of providing for the support of a hang rail which is rectangular in cross section and which will not inadvertently move or twist when used for supporting merchandise, especially when said merchandise is carried by cantilever mounted rods mounted on the hang rail.

SUMMARY OF THE INVENTION

A hang rail support and bracket in which the bracket is to be supported at its proximal end from a vertical standard or the like and a rectangular hang rail in turn supported from the forward or distal end of the bracket for enabling merchandise to be hung from the rail.

The bracket has a rectangular notch spaced rearwardly from the distal end thereof of a dimension to receive a hang rail of rectangular cross section therein, the notch being vertically arranged and opening upward so that the hang rail enters at the top and is moved downward to seat in the notch. The notch is formed by a punching operation and in the course of so forming the same at least one portion of the metal removed from the slot is left integral with the body of the bracket and bent at a right angle thereto substantially parallel with the side of the hang rail or bar that is to be accommodated in the notch. Thus a laterally extending tab is formed. The tab is provided with a central, perforated passageway in which there is mounted a friction member such as a rubber button or bumper, the thickness of the bumper facing the hang rail or bar when the latter is installed in the notch being great enough to produce an interference fit for the rail or bar in the notch. The bar or rail is installed in at least a pair of such spaced apart brackets and will have to be forced into the respective notches of the brackets against the frictional resistance caused by the bumpers pressing against a side of the rail or bar.

The bar is thus held against inadvertent removal or lengthwise sliding. The tab preferably has a vertical dimension somewhat less than the depth of the notch so that portions of the rail or bar can engage directly against opposite side edges of the notch and provide positive resistance to rotation of the bar or rail.

Modified structures are included.

DESCRIPTION OF THE PREFERRED EMBODIMENTS

The invention herein comprises the bracket of the invention independently and the bracket combination with a hang rail or bar of rectangular cross section.

Figure 11:
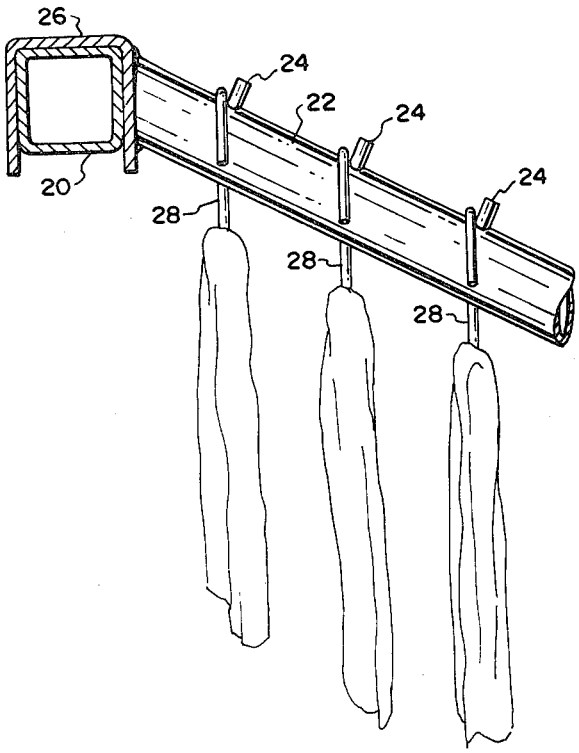
FIG. 11 is a sectional view taken through a square cross section hang rail or bar with a cantilever mounted rod being shown attached thereto for supporting articles of clothing.

In FIG. 11 there is illustrated a sectional view through a hang rail 20 of square cross section, usually hollow, and commonly of about an inch square intended to support merchandise. In this instance a conventional type of cantilever rod 22 is shown of round or rectangular cross section having a plurality of pins 24, slanted forwardly and downwardly from an inverted U-shaped bracket 26 engaged over the hang rail 20. Hangers of wire or wood are shown at 28 by means of which clothing may be supported on the rod 22 for display and examination. The weight of the clothing tends to rotate the bracket 26 about the rod 20 which in turn tends to twist the rod in its mounting.

The invention herein is concerned with brackets for supporting the rod 20, preventing it from twisting, preventing it from inadvertently being removed from said bracket and preventing it from being readily slid lengthwise.

Figure 1:
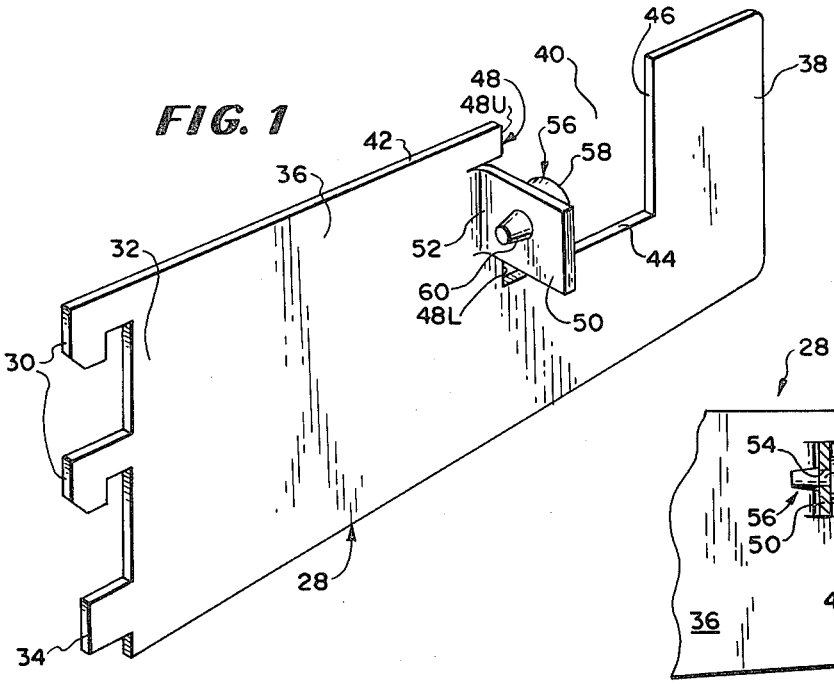
FIG. 1 is a perspective view of a bracket constructed in accordance with the invention, the hang rail not being shown.
Figure 2:
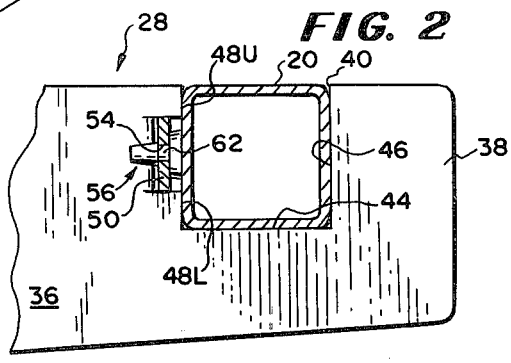
FIG. 2 is a fragmentary sectional view of the same bracket but taken generally along the plane 2—2 of FIG. 3 and in the direction indicated, the view including a square cross section bar or hang rail mounted to the bracket.
Figure 3:
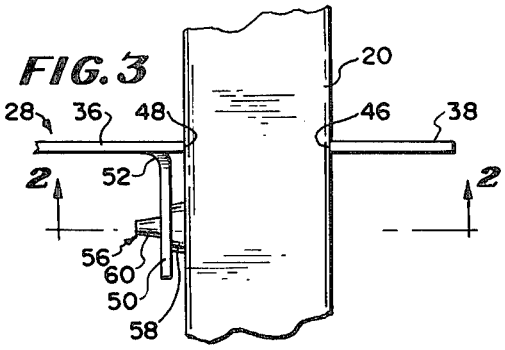
FIG. 3 is a fragmentary top plan view of the same bracket with the bar or hang rail in place.

In FIGS. 1 to 3 there is illustrated a simple but effective form of the invention which is extremely economical to manufacture. The bracket 28 is of stamped sheet metal and has hooklike formations 30 on its proximal end 32 cooperating with a tongue 34 by means of which the bracket 28 can be securely mounted to a vertical standard of conventional type (not shown) having vertical slots. The standard is usually mounted to a wall. Other means could be used to secure the bracket 28 to a vertical wall or support.

The body 36 of the bracket 28 is imperforate along its length and plain at its distal end 38 but there is a rectangular notch 40 cut into the body 36 opening to its upper edge 42 and having a bottom support edge 44, a front edge 46 and a rear support edge 48. As will be seen from the description which proceeds, the rear support edge 48 in this form of the invention comprises two parts, upper 48-U and lower 48-L.

The bracket 28 is formed by punching the same from sheet metal and likewise the notch 40 is so formed, but instead of fully punching the notch out of the body 36, it is formed by only partially removing the metal. In the center of the resulting metal piece there is formed a tab 50 that is connected with the body 36 by means of the bend 52 slightly rearward of the rear support edge 48. The tab 50 is provided by any well-known metal working technique as for example shear-forming. The tab 50 is arranged normal to the plane of the body 36 and, as mentioned, it is spaced a small distance rearwardly of the support edge 48. This is best seen in FIGS. 2 and 3.

A square cross section hang rail or bar 20 which is substantially identical to the bar 20 of FIG. 11 is adapted to be inserted into the notch 40 from the upper end thereof, the distance between the rear support edge 48 and the front support edge 46 being slightly greater than the transverse dimension of the rail or bar 20 so as to form a relatively close sliding fit therewith. The vertical depth of the notch 40 is substantially equal to the vertical dimension across the bar or rail 20 so that the upper face of the bar 20 is substantially flush with the upper edge of the bracket 28 as best seen in FIG. 2. For a square cross section bar or rail 20 the transverse horizontal and vertical dimensions will be the same so the notch 40 will be square.

With the bar or rail 20 so engaged in the notch 40, its front face will engage the front support edge 46 while its rear face will engage the rear support edge 48. Inasmuch as the rear support edge is formed of two parts 48U and 48L the bar or rail 20 is not engaged in its central part.

The tab 50 is normal to the plane of the sheet metal body 36 and parallel with the rear face of the bar or rail 20 when the latter is engaged in the notch 40 and is spaced rearwardly therefrom. A central passageway 54 is perforated through the tab 50 preferably at the same time that the tab 50 is being formed and a button or bumper 56 of an elastomer or of yieldable synthetic resin is inserted into the passageway. The button 56 has a front generally cylindrical head part 58 that is substantially larger than the passageway 54 and has an axial thickness that is greater than the spacing between the rear face of the rail or bar 20 and the tab 50. It has a rear reduced diameter tail part 60, the head and tail parts being connected by a neck portion 62. The button or bumper 56 is installed into the passageway 54 by distorting and forcing the tail part 60 while pushing same through the front of the passageway from right to left as viewed in FIG. 2 so the head part seats against the tab face.

This form of bumper or button 56 is used in merchandising fixtures of other kinds, in furniture and in sheet metal articles for bumper purposes and/or for enabling articles to be placed on polished surfaces without scratching. It is only described and illustrated by way of example, it being pointed out that any kind of bumper or button which is relatively yieldable can be used on the front fact of the tab 50 for the purposes of the invention. Its requirements are that it be secured to the tab, it be slightly yieldable, its thickness be sufficient so that it interferes with the bar or rail 20 as the latter is pushed into the notch 40. An example which is not illustrated and which is contemplated by the invention is a small relatively thick ring of elastmeric material that is engaged over the tab and moved into the center of the tab, this structure not requiring that a passageway be punched through the tab 50.

Figure 4:
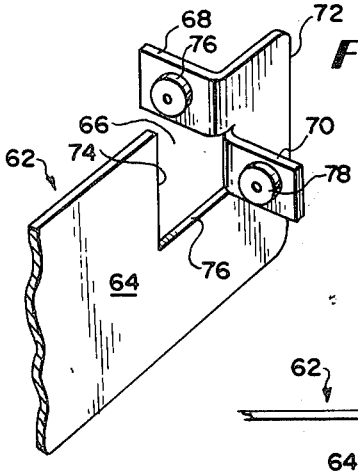
FIG. 4 is a fragmentary perspective view of the front end of a bracket for the same purpose as that of FIG. 1 but of a modified construction, the hang rail or bar not being shown.
Figure 5:
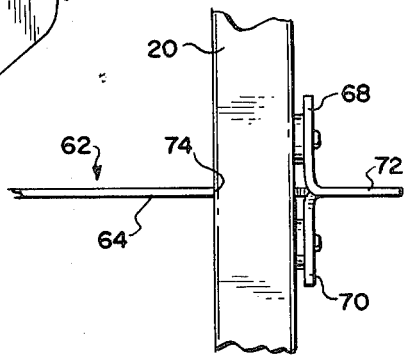
FIG. 5 is a top plan view similar to that of FIG. 3 but of the bracket of FIG. 4.

The form of the invention illustrated in FIGS. 4 and 5 is one in which there are two tabs punched out of the notch. The bracket 62 has a body 64 which is adapted to be mounted at its proximal end (not shown) to a wall or standard and extend forward therefrom. Spaced rearwardly from the distal end there is a vertical notch 66 which is punched into the body 64 from the upper edge thereof. There is an upper tab 68 and a lower tab 70 punched out of the material of the notch 66 and bent in opposite directions to be parallel with the bar or rail 20 that is to be accommodated in notch 66. The tabs 68 and 70 are formed on the front edge of the notch 66, being spaced rearwardly of the distal end 72 of the bracket 62. The notch 66 has a rear support edge 74 and a bottom support edge 76 to engage the rail or bar 20 when the latter is installed. Each of the tabs 68 and 70 has a friction button as shown at 76 and 78 suitably mounted and of a thickness to interfere with the insertion of the rail or bar 20 into the notch 66 so as to hold the rail or bar 20 tightly when it is fully inserted.

In use, the structure of FIGS. 4 and 5 requires that the installer force the bar 20 downward into the notch 66 against the pressure or friction of the bumpers 76 and 78. This is also true of the structure of FIGS. 1, 2 and 3.

Although not shown in FIGS. 4 and 5, the tabs 68 and 70 need not have vertical dimensions to occupy all of the vertical dimension of the notch 66 but may be slightly smaller so that there could be small support edges such as 48U and 48L at the upper and lower ends of the front edge of the notch 66.

Likewise, the tabs 68 and 70 could be formed from the rear edge of the notch as could the tab 50 be formed from the front edge 46 of the notch 40 of the bracket 28.

Figure 6:
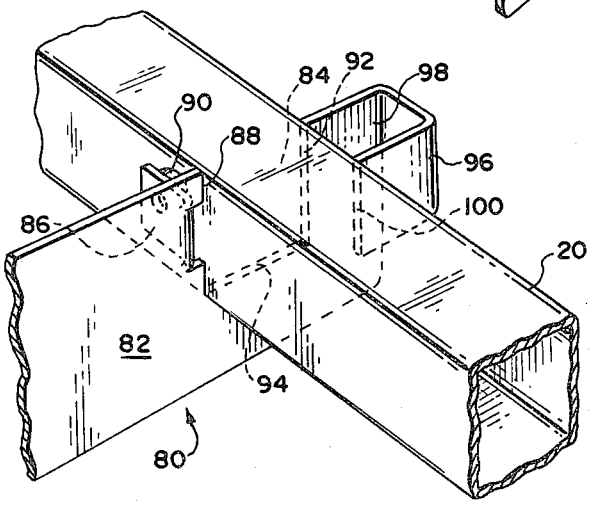
FIG. 6 is a fragmentary perspective view of a modified form of the invention here shown with a square cross section hang rail or bar in place.

In FIG. 6 there is illustrated a form of the invention which is based upon the structure of the bracket 28 of FIGS. 1 to 3. In this case the bracket 80 has its body 82 provided with means at the proximal end (not shown) for mounting the bracket 80 to a vertical standard or wall. A vertical notch 84 is cut into the body 82 from the upper edge thereof and a tab 86 is formed from the rear support edge 88 in much the same manner as the tab 50 is formed in the bracket 28. The only difference in this case is that the tab 86 is bent to the left side of the bracket 80 while the tab 50 is bent to the right side of the bracket 28.

A bumper or button 90 is again mounted on the tab 86 to provide an interference fit with the bar or rail 20 as it is pushed downward into the notch whereby to hold the bar or rail 20 tightly in the notch 84 against inadvertent removal or endwise sliding. The bar is also prevented from twisting because of its relatively close engagement within the notch 84, the support edge 88 cooperating with the front support edge 92 and the bottom support edge 94.

The bracket 80 of FIG. 6 has means for improving the stability thereof against lateral rocking relative to the bracket notch 84 and also additional stability against twisting. These means comprise a reverse bent tongue 96 integral with the distal end 98 of the bracket 80 and providing a second support edge 100 which is parallel with the front support edge 92 so that when the hang rail or bar 20 is pushed into place it has two spaced apart support edges 92 and 100 engaged against its forward face.

Other the hang rail or bar is an elongate rectangle in cross section rather than square as previously described. In such instances the normal disposition of the bar is with the longer cross section dimension vertical, the articles of merchandise which are hung from the bar being supported by brackets and rods which are constructed to straddle and/or be engaged upon the particular form of bar.

Figure 7:
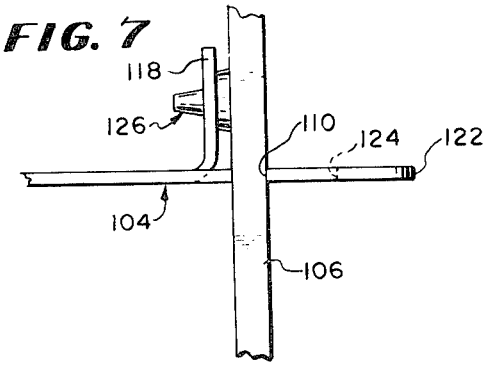
FIG. 7 is a top plan view similar to those of FIGS. 3 and 5 but of a further modified form of the invention, the hang rail or bar in this case being non-square rectangular in cross section with the greater dimension of the rectangle being disposed vertically.
Figure 8:
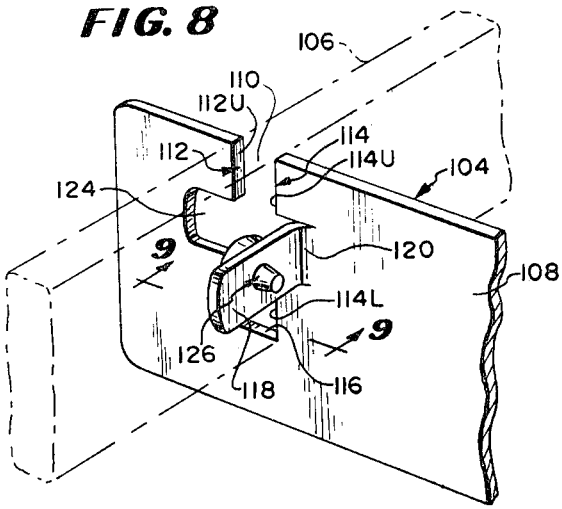
FIG. 8 is a fragmentary perspective view of the bracket of FIG. 7 but in this view the hang rail or bar is illustrated in phantom lines.
Figure 9:
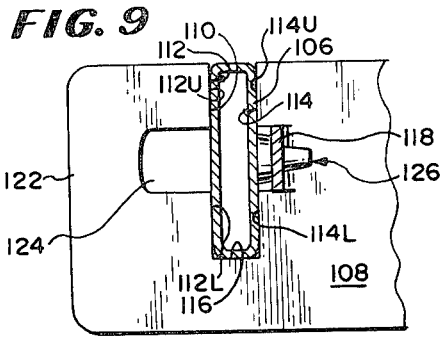
FIG. 9 is a fragmentary sectional view taken generally along the vertical plane 9—9 of FIG. 8 and in the indicated direction.

In FIGS. 7, 8 and 9 there is illustrated a form of bracket 104 which is constructed to accommodate a relatively thin elongate rectangular cross section bar 106. The bar may be solid metal or a hollow member as indicated in FIG. 9.

Inasmuch as it is desirable that the notch formed in the body 108 be of a configuration substantially matching that of the cross section of the bar 106, such a notch 110 is relatively narrow and is cut into the body 108 from the upper edge thereof and has a front support edge 112, a rear support edge 114 and a bottom support edge 116. Insofar as the rear support edge 114 is concerned, it is interrupted just as the edge 48 of the bracket 28 of FIGS. 1 to 3 is interrupted by the presence of a tab. In FIGS. 7 to 9 the tab is designated 118 and it divides the rear support edge into upper and lower parts which are designated 114U and 114L.

Because the front to back width of the notch 110 would normally be quite small relative to the same dimension of a notch such as 40, if the tab 118 were formed only out of the material of the notch 110 it might be too short to provide sufficient frictional pressure on the bar 106 and sufficient lateral stability when the bar is installed. For example, a notch to accommodate a one inch square bar like 20 would have sufficient material to provide a one inch long tab like 50, but a notch to accommodate a bar that is only one quarter inch thick would provide a tab that is only one quarter inch long. The required connecting bend such as shown at 120 shortens the tab even further.

According to the invention, because the tab 118 is shear formed from the body 108 at the same time that the notch 110 is punched, it can be longer than the width of the notch 110 and thus can extend past the notch 110 into the portion of the body 108 adjacent the distal end 122 of the bracket 104. Material is thus removed from that portion of the body 108 as indicated by the slot 124 but the effect upon the strength of the bracket 104 to support the bar 106 is minimum, if any. This is because the major support derives from the portion of the body 108 below the notch 110 and this portion is imperforate.

The tab 118 is bent at a right angle to the plane of the bracket 104 and spaced slightly from the bar 106 when the bar is in place. The tab is parallel to the rearwardly facing side of the bar and has a passageway therethrough similar to the passageway 54 of FIG. 2 to accommodate a button or bumper 126 whose head end interferes with the bar 106 when the bar is pushed downward into the notch 110. The resulting engagement is a frictional holding of the bar 106 in the notch 110 to resist inadvertent removal and endwise movement of the bar 106.

The front support edge 112 is thus divided by the entrance to the cutout slot 124 but provides upper and lower edges to serve as bearing means to engage the front surface of the bar 106 and prevent twisting thereof, cooperating with the rear support edge parts 114U and 114L. These upper and lower edge support means of the front support edge 112 may be designated 112U and 112L.

Figure 10:
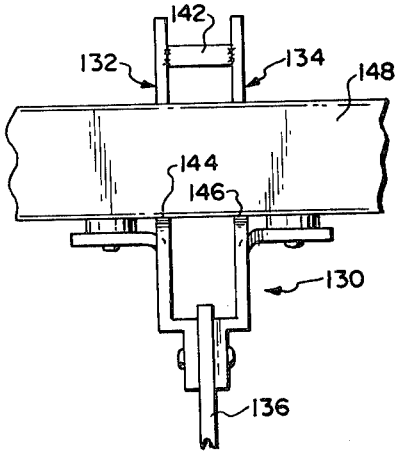
FIG. 10 is a fragmentary top plan view similar to those of FIGS. 3, 5 and 7 but of a still further modified form of the invention.

In FIG. 10 there is illustrated a bracket 130 which is intended for relatively heavy support and it may be used where greater lateral stability is desired. The structure actually comprises two assemblies 132 and 134 which are constructed, for example, like the distal end of the bracket 28 of FIGS. 1 to 3 connected together and mounted on the end of a single member adapted to be mounted to a standard or a wall. The single member is shown at 136 and is a vertically arranged bracket body. Each of the assemblies is a mirror configuration of the other and is provided at its rear end with an angled formation as at 138 and 140, respectively, connected to the body 136. The distal ends of the assemblies may be connected together by a welded link 142.

The structure of FIG. 10 will provide a pair of spaced apart notches 144 and 146 to receive the hang rail or bar 148, the latter being either of the type heretofore identified as 20 or the type heretofore identified as 106.

The invention is capable of considerable variation in the details thereof without in any way departing from the spirit or scope as defined in the appended claims.

What is claimed and desired to secure by Letters Patent of the United States is:

1. A support assembly for merchandise and including a rectangular cross section hang rail or bar extending between and supported by spaced apart brackets, said hang rail or bar being subject to rotational force during use thereof and said support assembly serving to resist said force, said assembly including the hang rail or bar in combination with said brackets for supporting same, and each bracket comprising:

A. an elongate bracket body having a proximal end and a distal end, the proximal end having means to enable the bracket body to be mounted to a vertical support structure, B. said bracket body comprising a vertically arranged sheet metal member having an upper edge, the sheet metal member defining generally a vertical plane, C. a vertically extending notch formed in said bracket body spaced rearwardly from the distal end thereof, said notch having front and rear support edges and a bottom support edge and the notch opening to the upper edge of the bracket body, said notch also having substantially the same configuration as the cross sectional configuration of at least a substantial portion of the lower part of the hang rail or bar if not all of the cross sectional configuration of the bottom and side faces of said hang rail or bar, D. a vertically disposed tab integrally connected at one of said front and rear support edges by means of a bend and extending generally at a right angle to the said plane of said bracket body, said tab being formed of at least a portion of the metal removed to provide said notch, the surface of said tab facing the notch being spaced slightly from the said one of said front and rear support edges at which it is connected and outside of said notch, E. a bumper member of yieldable material mounted on the said surface of the tab facing the notch and having a thickness which is greater than the spacing of the said surface from the support edge at which said tab is connected whereby the bumper member interferes with the hang rail or bar when the same is pressed into the notch thereby frictionally resisting removal of the hang rail or bar and endwise movement thereof, and F. the hang rail or bar adapted to be engaged into the notch with its lower face resting on the bottom support edge and its side faces substantially juxtaposed closely to the respective front and rear support edges if not engaging the same.

2. The support assembly as claimed in claim 1 in which the tab is connected at the rear support edge.

3. The support assembly as claimed in claim 1 in which the tab is longer than the horizontal width of the notch and is formed partially from the metal removed to provide said notch and partially from the body of said bracket adjacent the support edge opposite the edge at which the tab is connected.

4. The support assembly as claimed in claim 1 in which the support edge at which the tab is connected has upper and lower portions separated by the tab.

5. The support assembly as claimed in claim 1 in which there is a second tab having a second bumper member and the tab being connected by means of a second bend at one of said front and rear support edges.

6. The support assembly as claimed in claim 5 in which both of said tabs are connected to the same support edge and extend in opposite lateral directions therefrom.

7. The support assembly as claimed in claim 1 in which the tab is at most as long as the horizontal width of said notch and formed wholly of the metal removed to provide said notch.

8. The support assembly as claimed in claim 1 in which there is a reverse bent tongue on the said distal end having an edge engaging the side face of the hang rail or bar which faces away from the proximal end of the bracket.

9. The support assembly as claimed in claim 8 in which the tab is connected at the rear support edge whereby the tab and tongue edge engage opposite faces of said hang rail or bar.

10. The support assembly as claimed in claim 1 in which the tab has a passageway formed therein and said bumper member comprises an elastomeric button having head and tail formations joined by a neck, said neck being engaged in the passageway with the head formation engaging the hang rail or bar when the latter is installed in the notch.

11. The support assembly as claimed in claim 1 in which each said bracket comprises a pair of said bracket bodies identical but mirror configurations of one another, spaced apart whereby to provide two of said tabs, two of said notches and two of said bumper members, the said hang rail or bar being engaged in both notches and engaged by both of the said bumper members, the bracket bodies being coupled together and the means to enable them to be mounted to a vertical support structure being common to both bracket bodies.

12. A supporting bracket for a generally rectangular cross section hang rail or bar which is adapted to extend between at least two such brackets, said bracket comprising:

A. an elongate bracket body having a proximal end and a distal end, the proximal end having means to enable the bracket body to be mounted to a vertical support structure, B. said bracket body comprising a vertically arranged sheet metal member having an upper edge, the sheet metal member defining generally a vertical plane, C. a vertically extending notch formed in said bracket body spaced rearwardly from the distal end thereof, said notch having front and rear support edges and a bottom support edge and the notch opening to the upper edge of the bracket body, said notch also having substantially the same configuration as the cross sectional configuration of at least a substantial portion of the lower part of a hang rail or bar adapted to be received in said notch, D. a vertically disposed tab integrally connected at one of said front and rear support edges by means of a bend and extending generally at a right angle to the said plane of said bracket body, said tab being formed of at least a portion of the metal removed to provide said notch, the surface of said tab facing the notch being spaced slightly from the said one of said front and rear support edges at which it is connected and outside of said notch, E. a bumper member of yieldable material mounted on the said surface of the tab facing the notch and having a thickness which is greater than the spacing of the said surface from the support edge at which said tab is connected whereby the bumper member will interfere with a hang rail or bar that is pressed into the notch thereby frictionally resisting removal of the hang rail or bar and endwise movement thereof, and F. the notch adapted to receive the hang rail or bar with its lower face resting on the bottom support edge and its side faces substantially juxtaposed closely to the respective front and rear support edges if not engaging the same when said hang rail or bar is in place.

13. The bracket as claimed in claim 12 in which the tab is connected at the rear support edge.

14. The bracket as claimed in claim 12 in which the tab is longer than the horizontal width of the notch and is formed partially from the metal removed to provide said notch and partially from the body of said bracket adjacent the support edge opposite the edge at which the tab is connected.

15. The bracket as claimed in claim 12 in which the support edge at which the tab is connected has upper and lower portions separated by the tab.

16. The bracket as claimed in claim 12 in which there is a second tab having a second bumper member and the tab being connected by means of a second bend at one of said front and rear support edges.

17. The bracket as claimed in claim 16 in which both of said tabs are connected to the same support edge and extend in opposite lateral directions therefrom.

18. The bracket as claimed in claim 12 in which the tab is at most as long as the horizontal width of said notch and formed wholly of the metal removed to provide said notch.

19. The bracket as claimed in claim 12 in which there is a reverse bent tongue on the said distal end having an edge adapted to engage the side face of a hang rail or bar which is intalled in said notch.

20. The bracket as claimed in claim 19 in which the tab is connected at the rear support edge whereby the tab and tongue edge are adapted to engage respective opposite faces of said hang rail or bar.

21. The bracket as claimed in claim 12 in which the tab has a passageway formed therein and said bumper member comprises an elastomeric button having head and tail formations joined by a neck, said neck being engaged in the passageway with the head formation disposed to engage a hang rail or bar when the latter is installed in the notch.

22. The bracket as claimed in claim 12 which comprises a pair of said bracket bodies identical but mirror configurations of one another, spaced apart whereby to provide two of said bumper members, the said hang rail or bar adapted to be engaged in both notches and engaged by both of the said bumper members, the bracket bodies being coupled together and the means to enable them to be mounted to a vertical support structure being common to both bracket bodies.

23. A bar-supporting bracket member for supporting and firmly holding a load supporting bar of rectangular cross-section which is adapted to extend between at least two support stations, at least one of which comprises said bracket member, said bracket member comprising:

A. a bracket body adapted to be mounted in a generally horizontal disposition and having a proximal end and a distal end, the proximal end being adapted for mounting to a vertical support structure, B. said bracket body comprising a vertically arranged sheet metal member having an upper edge, the sheet metal member defining generally a vertical plane, C. a vertically extending notch formed in said bracket body adjacent the distal end thereof but spaced rearwardly therefrom, said notch having front and rear vertical support edges and a bottom generally horizontal support edge and the notch opening to the upper edge of the bracket body, said notch also having substantially the same configuration as the cross sectional configuration of at least a substantial portion of the lower part of the load-supporting bar adapted to be received in said notch, D. a vertically disposed tab integrally connected at one of said front and rear support edges by means of a bend and extending generally at a right angle to the said plane of said bracket body, said tab being formed of at least a portion of the metal removed to provide said notch, the surface of said tab facing the notch being spaced slightly from the said one of said front and rear support edges at which it is connected and outside of said notch, E. a bumper member of yieldable material mounted on the said surface of the tab facing the notch and having a thickness which is greater than the spacing of the said surface from the support edge at which said tab is connected whereby the bumper member will interfere with a bar that is pressed into the notch thereby frictionally resisting removal of the bar and endwise movement thereof, and F. the notch adapted to receive the bar with its lower face resting on the bottom support edge and its side faces substantially juxtaposed closely to the respective front and rear support edges if not engaging the same when said bar is in place.

* * * * *

UNITED STATES PATENT AND TRADEMARK OFFICE

CERTIFICATE OF CORRECTION

PATENT NO. : 4,316,546

DATED : February 23, 1982

INVENTOR(S) : David S. Varon & I. Irving Silverman

It is certified that error appears in the above-identified patent and that said Letters Patent are hereby corrected as shown below:

On the cover page, block [75], change "Irving Silverman" to --I. Irving Silverman--.

On the cover page, block [57], line 5, change "merchandize" to --merchandise--.

Column 5, line 58, change "Other" to --Often--.

Signed and Sealed this

*Twenty-fifth* Day of *May 1982*

[SEAL]

*Attest:*

GERALD J. MOSSINGHOFF

*Attesting Officer*

*Commissioner of Patents and Trademarks*